US009006984B2

(12) United States Patent
Akiyama

(10) Patent No.: US 9,006,984 B2
(45) Date of Patent: Apr. 14, 2015

(54) LED LIGHTING DEVICE

(75) Inventor: Takashi Akiyama, Saitama (JP)

(73) Assignees: Citizen Holdings Co., Ltd., Tokyo (JP); Citizen Electronics Co., Ltd., Yamanashi (JP)

( * ) Notice: Subject to any disclaimer, the term of this patent is extended or adjusted under 35 U.S.C. 154(b) by 0 days.

(21) Appl. No.: 13/817,234

(22) PCT Filed: Aug. 24, 2012

(86) PCT No.: PCT/JP2012/071478

§ 371 (c)(1),
(2), (4) Date: Feb. 15, 2013

(87) PCT Pub. No.: WO2013/031695

PCT Pub. Date: Mar. 7, 2013

(65) Prior Publication Data

US 2013/0234609 A1 Sep. 12, 2013

(30) Foreign Application Priority Data

Aug. 26, 2011 (JP) ..... 2011-184243

(51) Int. Cl.
*H05B 37/00* (2006.01)
*H05B 33/08* (2006.01)

(52) U.S. Cl.
CPC ..... *H05B 33/0821* (2013.01); *H05B 33/083* (2013.01)

(58) Field of Classification Search
CPC ..... H05B 33/0821
USPC ..... 315/185 R; 323/314, 315
See application file for complete search history.

(56) References Cited

U.S. PATENT DOCUMENTS

| | | | | |
|---|---|---|---|---|
| 4,641,081 | A | 2/1987 | Sato et al. | |
| 7,317,403 | B2 * | 1/2008 | Grootes et al. | 340/815.45 |
| 7,598,686 | B2 * | 10/2009 | Lys et al. | 315/312 |
| 8,278,840 | B2 * | 10/2012 | Logiudice et al. | 315/294 |
| 8,664,869 | B2 * | 3/2014 | Grebner et al. | 315/186 |
| 8,680,769 | B2 * | 3/2014 | Wei et al. | 315/90 |

(Continued)

FOREIGN PATENT DOCUMENTS

| | | |
|---|---|---|
| JP | 2007-043179 A | 2/2007 |
| JP | 2007-43197 A | 2/2007 |

(Continued)

OTHER PUBLICATIONS

Japan Patent Office, Office Action for Japanese Application No. 2013-501478, Feb. 26, 2013.
Taiwan Intellectual Property Office, Office Action for Taiwan Patent Application 102104848, Nov. 24, 2014.

*Primary Examiner* — Douglas W Owens
*Assistant Examiner* — Srinivas Sathiraju

(57) ABSTRACT

When a pulsating current is applied to an LED string included in an LED lighting device, and the number of LEDs caused to light up is changed, the LED lighting device is in efficient, since there are LEDs lighting up for a long period of time and LEDs lighting up only for a short period of time. The LED string includes LED string 407 that lights up for a long period of time and LED string 408 that lights up only for a short period of time within a period of the pulsating current. The element size of the LED 102 included in LED string 407 is different from the element size of LED 203 string 408. Thus, the amount of light emission per unit area LED string 407 may be equal to the amount of light emission per unit area LED string 408.

13 Claims, 7 Drawing Sheets

(56) References Cited

U.S. PATENT DOCUMENTS

| | | | | |
|---|---|---|---|---|
| 2007/0029915 | A1 | 2/2007 | Kim et al. | |
| 2008/0094000 | A1 | 4/2008 | Yamamoto et al. | |
| 2009/0026977 | A1* | 1/2009 | Omi | 315/294 |
| 2009/0090929 | A1 | 4/2009 | Tu et al. | |
| 2010/0052565 | A1 | 3/2010 | Kitamura et al. | |
| 2010/0060175 | A1* | 3/2010 | Lethellier | 315/164 |
| 2011/0062888 | A1* | 3/2011 | Bondy et al. | 315/294 |
| 2011/0109244 | A1* | 5/2011 | Grajcar | 315/294 |
| 2011/0163682 | A1* | 7/2011 | Jungwirth | 315/192 |
| 2011/0221352 | A1* | 9/2011 | Grebner et al. | 315/186 |
| 2012/0038284 | A1 | 2/2012 | Setomoto et al. | |

FOREIGN PATENT DOCUMENTS

| | | | |
|---|---|---|---|
| JP | 2008-059811 | A | 3/2008 |
| JP | 2008-59811 | A | 3/2008 |
| JP | 2009-94459 | A | 4/2009 |
| JP | 2009-094459 | A | 4/2009 |
| JP | 2010-80926 | A | 4/2010 |
| JP | 4581646 | B2 | 11/2010 |
| TW | 201143518 | A1 | 12/2011 |
| WO | 2010/143362 | A1 | 12/2010 |
| WO | 2010/143396 | A1 | 12/2010 |
| WO | 2011/020007 | A1 | 2/2011 |

* cited by examiner

LED LIGHTING DEVICE

TECHNICAL FIELD

The present invention relates to an LED lighting device including an LED string in which a plurality of LEDs is connected in series as a light source and, in more detail, to an LED lighting device that switches the numbers of LEDs connected in series in the LED string caused to light up in accordance with a voltage applied to the LED string or a current flowing through the LED string.

BACKGROUND

A lighting device that causes LEDs (also called a light-emitting diode) to light up by a voltage waveform in the shape of a pulsating current or in the shape close to a pulsating current obtained by full-wave rectifying a commercial AC power source is known (hereinafter, referred to as an LED lighting device). This LED lighting device includes an LED string in which a plurality of LEDs is connected in series so as to be capable of resisting a high voltage, and has a threshold value and when the threshold value is exceeded, a current flows through the LED string and the LED string lights up. This threshold value is set to a value somewhat lower than the peak of the pulsating voltage (about 140 V), and therefore, when the effective value of the commercial power source is 100 V, the threshold value is set to about 100 to 120 V. Each of the LEDs has a threshold value called a forward voltage Vf and when a voltage equal to or higher than the forward voltage Vf is applied, a current flows and the LED lights up. The threshold value of the LED string is the sum of the forward voltage Vf of each LED included in the LED string.

When a pulsating voltage is simply applied to the LED string, the LED string lights up only for a period of time during which the pulsating voltage exceeds a threshold voltage. Thus, the LED string becomes dark and flickering becomes conspicuous and further, the power factor and the distortion factor also deteriorate. If the number of LEDs connected in series in the LED string is reduced to shorten the non-lighting period of time, the power loss of a current limiting circuit inserted in series with the LED string becomes large, and therefore, this is not preferable. Thus, there is proposed an LED lighting device intended to solve the above-described problems by switching the numbers of LEDs connected in series in the LED string caused to light up in accordance with a voltage applied to the LED string or a current flowing through the LED string (for example, Patent Documents 1, 2).

In FIG. 1 of Patent Document 1, a light-emitting diode lighting device (LED lighting device) is described, which adjusts the number of light-emitting diodes 14 (connected in series) caused to light up by dividing a light-emitting diode circuit 15 (LED string) into six diode circuits 17 to 22 and switching drive switches 30 to 35 based on a pulsating voltage.

In a circuit in which current paths are switched based on the pulsating voltage as in Patent Document 1, the current flowing through the LED string is reduced or increased considerably at the instant when the paths are switched. In other words, the current value becomes discontinuous and this causes various problems, such as an increase in harmonic noise. In contrast to this, in the LED drive circuit illustrated in FIG. 26 of Patent Document 2, by measuring the current flowing through the LED string, when the current exceeds a predetermined value, the number of LEDs connected in series in the LED string is increased and at the same time, the current is also increased continuously.

The circuit of FIG. 26 of Patent Document 2 is explained briefly (see FIG. 8). In FIG. 8, there is an LED string including an LED group 1, an LED group 2, and an LED group 3. When the current flowing through the LED string is small, a FET Q1 bypasses the current flowing through the LED group 1 and the LED group 2 and no electric flows through the LED group 3 (the LED group 3 does not light up). When the current increases, the circuit operates so that the sum of the current flowing through the FET Q1 and the current flowing through the LED group 3 is constant. At this time, the LED group 3 lights up faintly. When the current increases further and exceeds a predetermined value, the FET Q1 cuts off and all the currents flow through the LED group 3 and the LED group 3 lights up fully together with the LED groups 1 and 2. When the current decreases, the reverse operation is performed. The upper limit of the current is limited by a current limiting resistor R1.

When the LED is caused to light up in the circuit illustrated in FIG. 26 of Patent Document 1 illustrated in FIG. 8, if the pulsating voltage becomes high, the current flowing through the LED string also increases and if the pulsating voltage becomes low, the current flowing through the LED string also decreases, and therefore, there is an advantage that the power factor and the distortion factor are excellent.

Patent Document 1: JP-458646 (FIG. 1)

Patent Document 2: WO2011/020007 (FIG. 26)

SUMMARY

However, not only in the light-emitting diode circuit 15 (LED string) illustrated in FIG. 1 of Patent Document 1 but also in the LED groups 1, 2, and 3 (LED string) illustrated in FIG. 26 of Patent Document 2, while a part of the LED string lights up for a long period of time from the period of time during which the pulsating voltage is low to the period of time during which it is high, the other part of the LED string lights up only for the period of time during which the pulsating voltage is high, i.e., only for a short period of time. Thus, while a part of the LED string lights up for a long period of time and operate efficiently, the other part lights up only for a short period of time, and therefore, operates inefficiently. If there is an inefficient part, various problems arise, such as the device increases in scale and cost is increased.

The present invention has been made in view of the above-described problems and an object thereof is to provide an LED lighting device including a LED string in which a plurality of LEDs is connected in series as a light source, wherein the numbers of LEDs caused to light up are switched in accordance with a voltage applied to the LED string or current, and the LEDs included in the LED string operate efficiently.

An LED lighting device of the present invention is an LED lighting device including an LED string in which a plurality of LEDs is connected in series as a light source, in which a pulsating current is applied to the LED string, there are a part that lights up for a long period of time and a part that lights up only for a short period of time within the period of the pulsating current in the LED string, and the element size of the LED included in the part that lights up for a long period of time is different from the element size of the LED included in the part that lights up only for a short period of time.

(Working)

In an LED, when a current increases, an amount of light emission increases, however, light emission efficiency reduces. In other words, as the current increases, the amount of light emission per unit area on the surface of the LED element increases, and therefore, the area utilization efficiency increases, however, on the other hand, the light emission efficiency expressed as a ratio of energy emitted as light to input energy reduces. When a current caused to flow through the LED string (also referred to as a forward current If) is set appropriately, if the element size of the LED included in the part that lights up for a long period of time is increased in the LED string, the amount of light emission is large, and therefore, it is possible to keep the area utilization efficiency high and further, the current density reduces, and therefore, it is also possible to keep the light emission efficiency high. At this time, the LED included in the part that lights up only for a short period of time is small in the element size, and therefore, the area utilization efficiency is high even if the amount of light emission is small and the amount of current per unit time is small, and therefore, the light emission efficiency is excellent. Thus, for the LED elements included in one LED string, by making larger the size of the LED included in the part that lights up for a long period of time than the size of the LED included in the part that lights up only for a short period of time, the LEDs operate efficiently in both parts.

Further, it is preferable that the element size of the LED included in the part that lights up for a long period of time is larger than the element size of the LED included in the part that lights up only for a short period of time.

Further, it is preferable that the LEDs included in the part that lights up only for a short period of time are integrated.

Further, it is preferable to include a bypass circuit at a connection part of the part that lights up for a long period of time and the part that lights up only for a short period of time, wherein current is caused to flow into the bypass circuit from the part that lights up for a long period of time until the current flowing into the part that lights up only for a short period of time exceeds a predetermined value.

Further, it is preferable that the bypass circuit includes a depression type FET.

As explained above, the LED lighting device of the present invention includes the LED string in which a plurality of LEDs is connected in series as a light source and by switching the numbers of LEDs caused to light up in accordance with the voltage applied to the LED string or current, the LEDs included in the LED string operate efficiently.

BRIEF DESCRIPTION OF THE DRAWINGS

These and other features and advantages of the present invention will be better understood by reading the following description of embodiments taken together with the drawings wherein.

DESCRIPTION OF EMBODIMENTS

Hereinafter, a preferred embodiment of the present invention is explained in detail with reference to the accompanying FIGS. 1 to 7. In the explanation of the drawings, the same symbol is attached to the same or corresponding element and duplicated explanation is omitted. The scale of members is changed appropriately for explanation. Further, the relationship with the invention specifying items described in the claims is described within brackets.

Figure 1:
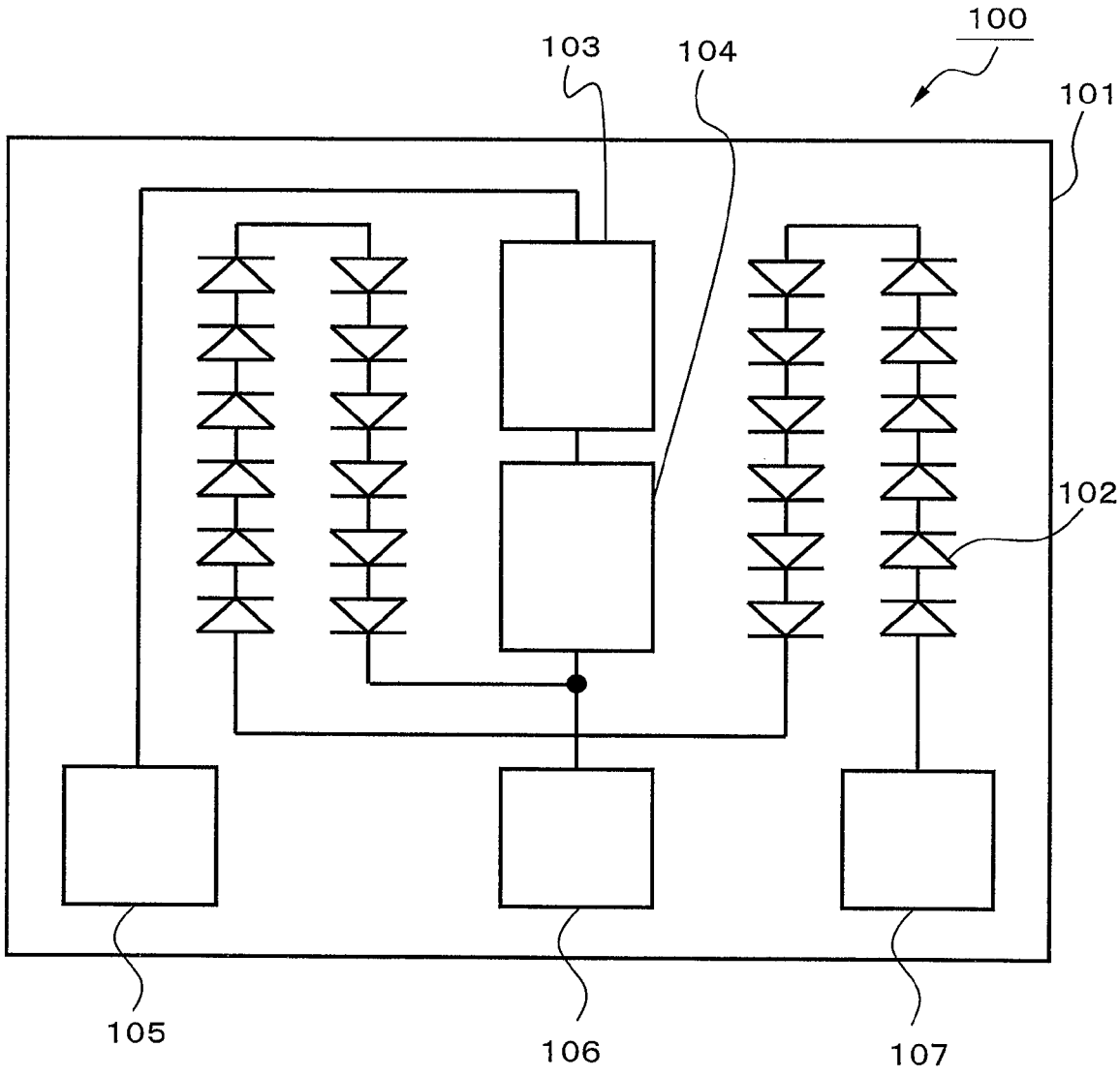
FIG. 1 is a circuit diagram illustrating a light emitting unit.

A light emitting unit 100 included in the embodiment of the present invention is explained with reference to FIG. 1. FIG. 1 is a circuit diagram of the light emitting unit 100. In the light emitting unit 100, on a substrate 101, there are 24 LEDs 102, two integrated LEDs 103 and 104, and three terminals 105, 106, and 107. The 24 LEDs 102 are connected in series. The anode of the LED string is connected to the terminal 107 and the cathode is connected to the terminal 106 and the lower terminal of the integrated LED 104. The integrated LEDs 104 and 103 are connected in series and the upper terminal of the integrated LED 103 is connected to the terminal 105.

Figure 2:
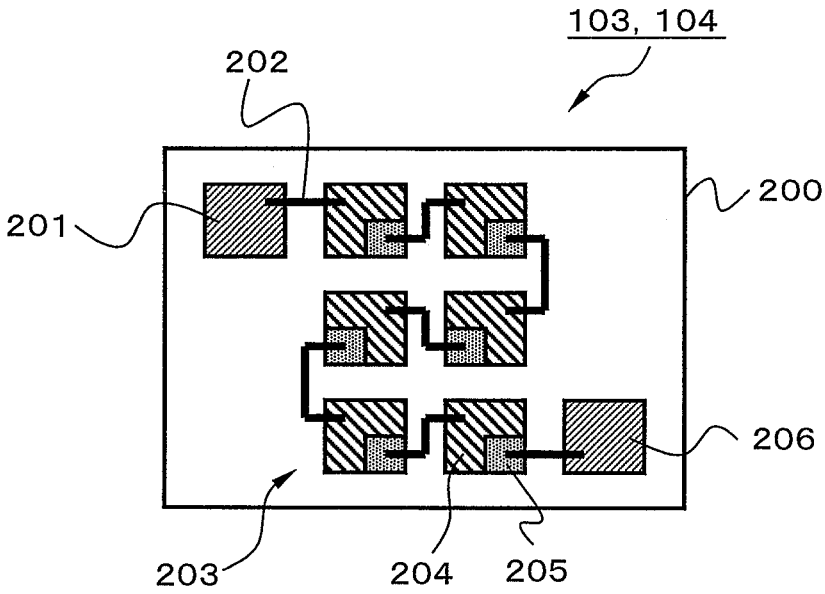
FIG. 2 is a plane view of an integrated LED included in the light emitting unit illustrated in FIG. 1.
Figure 3:
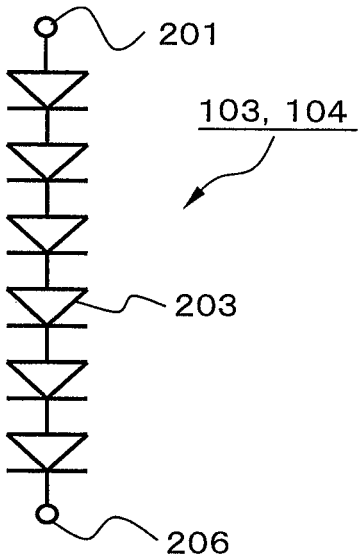
FIG. 3 is a circuit diagram of the integrated LED illustrated in FIG. 2.

Before detailed explanation of FIG. 1, the integrated LEDs 103 and 104 illustrated in FIG. 1 are explained with reference to FIGS. 2 and 3. FIG. 2 is a plan view of the integrated LEDs 103 and 104 and FIG. 3 is a circuit diagram of the integrated LEDs 103 and 104. As illustrated in FIG. 2, on a die 200, there are pads 201 and 206 and six LEDs 203 and in the LED 203, there are a p-type semiconductor region 204 and an n-type semiconductor region 205. The pad 201 is connected to the p-type semiconductor region 204 of the LED 203 at the upper left by a wire 202. Similarly, the pad 206 is connected to the n-type semiconductor region 205 of the LED 203 at the bottom right by the wire 202. In addition to the above, the n-type semiconductor region 205 of each LED 203 is connected to the p-type semiconductor region 204 of the neighboring LED 203 by the wire 202.

The die 200 is an insulating substrate, such as sapphire, cut out of a wafer. The LED 203 has a structure in which a p-type semiconductor layer is stacked on an n-type semiconductor layer and the n-type semiconductor region 205 is formed by removing part of the p-type semiconductor layer to expose the n-type semiconductor layer. The light emitting layer is located at the boundary part of the n-type semiconductor layer and the p-type semiconductor layer and the planar shape thereof is substantially the same as the planar shape of the p-type semiconductor region 204.

The p-type semiconductor region 204 is the anode of the LED 203 and the n-type semiconductor region 205 serves as the cathode of the LED 203. Then, as illustrated in FIG. 3, in the integrated LEDs 103 and 104, the six LEDs 203 are connected in series and the pad 201 is the anode of the diode string and the pad 206 is the cathode.

Figure 4A:
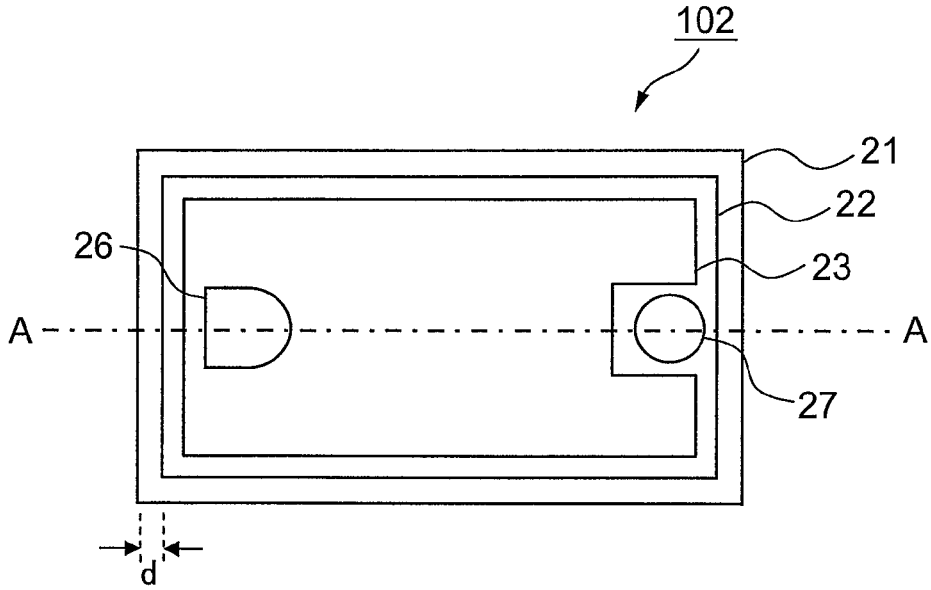
FIG. 4A is a plane view of an LED.
Figure 4B:
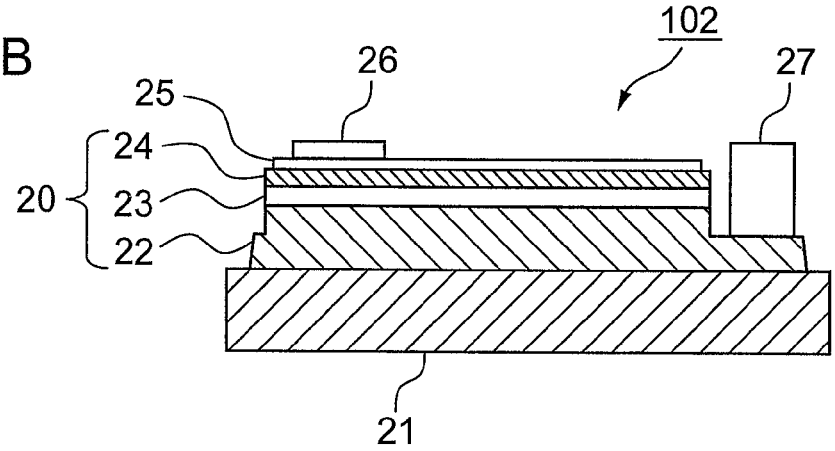
FIG. 4B is a section view of an LED.

Returning to FIG. 1 again, the light emitting unit 100 is explained. The integrated LEDs 103 and 104 are formed by connecting the LEDs 203 in series (see FIGS. 2 and 3), and therefore, as the light emitting unit 100, the LED string is formed from the terminal 107 toward the terminal 105. The LED 102 is an individual die or package die, and therefore, the element size is larger than that of the LED 203. The element size corresponds to the area of the semiconductor layer or the area of the light emitting layer of the LEDs 102 and 203. The area of the light emitting layer is explained specifically. FIGS. 4A and 4B illustrate a plan view and a section view of the LED 102. FIG. 4A illustrates a plan view of the LED 102 and FIG. 4B illustrates a section view along A-A of FIG. 4A. As illustrated in FIG. 4B, the LED 102 includes a semiconductor stacked structure 20 including a light emitting layer on an LED substrate 21 made of sapphire. The semiconductor stacked structure 20 includes an n-type semiconductor layer 22, a light emitting layer 23, and a p-type semiconductor layer 24. The n-type semiconductor layer 22 is provided with a negative electrode side terminal 27 and the p-type semiconductor layer 24 is provided with a positive electrode side terminal 26 via a transparent conductive layer 25 made of ITO, and the light emitting layer 23 emits light by applying a voltage equal to or higher than a threshold value between the positive electrode side terminal 26 and the negative electrode side terminal 27. As illustrated in FIG. 4, the element size in the present embodiment corresponds to the area of the light emitting layer 23.

Figure 5:
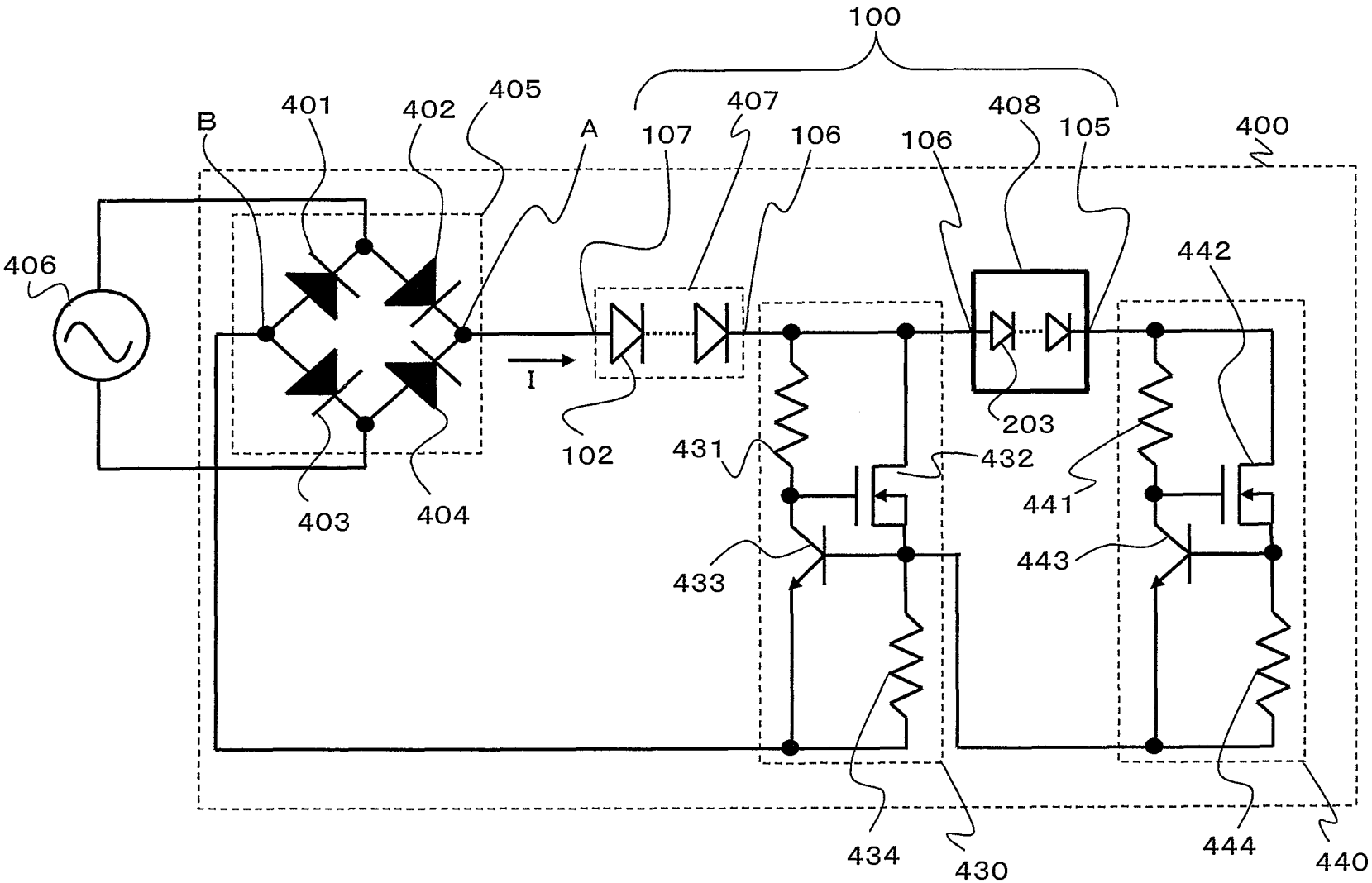
FIG. 5 is a circuit diagram illustrating a circuit for driving the light emitting unit illustrated in FIG. 1.

Next, an LED lighting device 400 in the present embodiment is explained with reference to FIG. 5. FIG. 5 is a diagram of a circuit for driving the light emitting unit 100 illustrated in FIG. 1. The LED lighting device 400 is connected to a commercial power source 406 and includes, in addition to the light emitting unit 100, a bridge rectifier circuit 405, a bypass circuit 430, and a constant current circuit 440.

The light emitting unit 100 includes a partial LED string 407 in which the LEDs 102 are connected in series and a partial LED string 408 in which the LEDs 203 are connected in series. The partial LED string 407 corresponds to the LED string of the 24 LEDs 102 connected in series in FIG. 1 and it is illustrated that the anode is connected to the terminal 107 and the cathode to the terminal 106. The partial LED string 408 corresponds to the integrated LED 103 and the integrated LED 104 connected in series in FIG. 1 and in which the 12 LEDs 203 illustrated in FIGS. 2 and 3 are connected in series. In FIG. 5, the black frame surrounding the partial LED string 408 indicates that the partial LED string 408 includes the integrated LEDs 103 and 104. Further, the LED 203 is drawn smaller than the LED 102 to indicate that the element size of the LED 203 is smaller than the element size of the LED 102. Furthermore, it is illustrated that the anode of the partial LED string 408 is connected to the terminal 106 illustrated in FIG. 1 and the cathode to the terminal 105.

The bridge rectifier circuit 405 is a diode bridge including four diodes 401 to 404 and the commercial power source 406 is connected to the AC input side of the diode bridge. A terminal A and a terminal B are the terminal on the current outflow side and the terminal on the current inflow side, respectively, of the bridge rectifier circuit 405. The terminal A is connected to the terminal 107 of the partial LED string 407 and the terminal B is connected to the negative side terminal of the bypass circuit 430.

The bypass circuit 430 includes resistors 431 and 434, an n-type MOS transistor 432 (hereinafter, referred to as a FET), and an NPN-type bipolar transistor 433 (hereinafter, referred to as a transistor). The positive side terminal of the bypass circuit 430 is the connection part of the upper end of the resistor 431 and the drain of the FET 432 and the negative side terminal is the connection part of the emitter of the transistor 433 and the lower end of the resistor 434. The current detection terminal is the connection part of the source of the FET 432, the base of the transistor 433, and the upper end of the resistor 434. The positive side terminal is connected to the terminal 106 of the partial LED strings 407 and 408 and the negative side terminal is connected to the terminal B of the bridge rectifier circuit 405. The current detection terminal is connected to the negative side terminal of the constant current circuit 440 and causes the current that flows in from the constant current circuit 440 to flow toward the terminal B of the bridge rectifier circuit 405 via the resistor 434 and the transistor 433.

The constant current circuit 440 includes resistors 441 and 444, a FET 442, and a transistor 443. The positive side terminal of the constant current circuit 440 is the connection part of the upper end of the resistor 441 and the drain of the FET 442 and connected to the terminal 105 of the partial LED string 408. The negative side terminal is the connection part of the emitter of the transistor 443 and the lower end of the resistor 444 and connected to the current detection terminal of the bypass circuit 430.

Figure 6A:
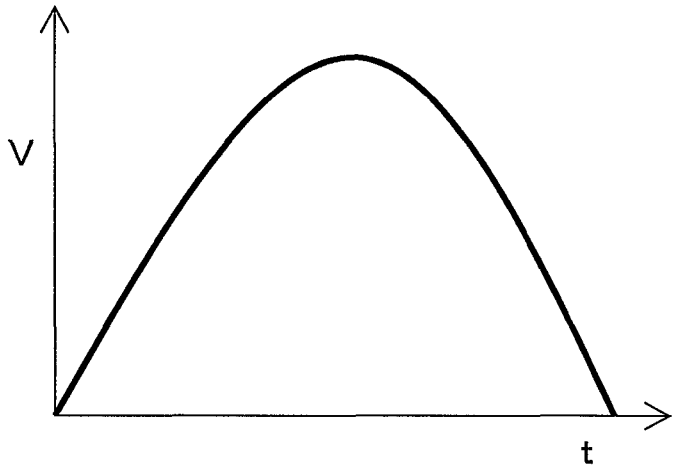
FIG. 6A is a waveform diagram of the circuit illustrated in FIG. 5.
Figure 6B:
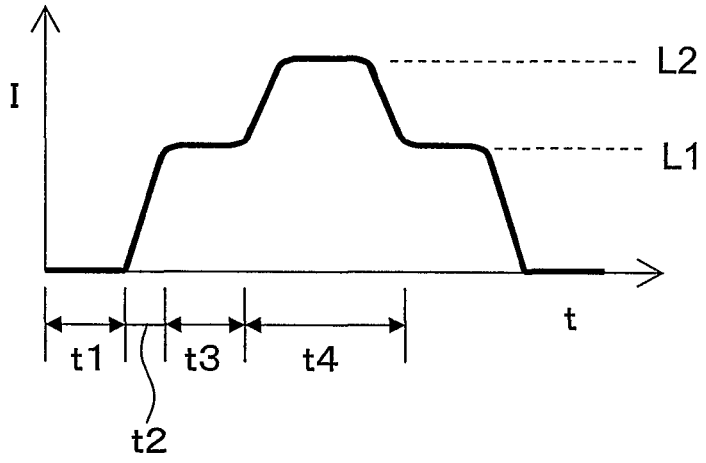
FIG. 6B is a waveform diagram of the circuit illustrated in FIG. 5.

Next, the operation of the circuit of FIG. 5 is explained using FIGS. 6A and 6B. FIG. 6A is a waveform diagram illustrating a voltage waveform at the terminal A when the terminal B of the bridge rectifier circuit 405 is taken to be a reference and FIG. 6B is a waveform diagram illustrating a waveform of current flowing from the terminal A toward the terminal B in the circuit of FIG. 5. FIG. 6A illustrates one period of the pulsating voltage and the time axis of FIG. 6A agrees with that of FIG. 6B. The current waveform of FIG. 6B includes a period of time t1 during which no current flows, a period of time t2 during which the current increases rapidly, a period of time t3 during which the current is constant, and a period of time t4 during which the current increases further and decreases after a constant current state. When the rise and fall of the pulsating voltage is symmetric about the peak, the current waveform will also be substantially symmetric.

Next, the circuit of FIG. 5 is explained in comparison with FIG. 6. During the period of time t1, the pulsating voltage is lower than the threshold value of the partial LED string 407, and therefore, a current I does not flow. The forward voltage of the LED 102 is about 3 V, and therefore, the period of time t1 is a period of time during which the pulsating voltage rises from 0 V to about 70 V. During the period of time t2 after that, the current I increases rapidly as the pulsating voltage rises. During the period of time t1, the voltage of the upper end of the resistor 434 for detecting a current does not reach 0.6 V, and therefore, the FET 432 is in the ON state.

When the current I reaches a predetermined value L1 and the voltage of the upper end of the resistor 434 reaches 0.6 V, the period of time t3 starts. During the period of time t3, feedback is applied so that the voltage between base and emitter of the transistor 433 is kept at 0.6 V, and therefore, the current I is a constant current. At the last part of the period of time t3, the pulsating voltage becomes higher than the sum of the threshold value of the partial LED string 407 and the threshold value of the partial LED string 408 and a current flows also through the partial LED string 408. At this time, control is performed so that the sum of the current flowing through the FET 432 and that flowing through the partial LED string 408 is constant.

When the pulsating voltage rises further, the period of time t4 starts. When the period of time t4 starts, the current flowing through the partial LED string 408 increases and the voltage of the upper end of the resistor 434 rises. Then, the transistor 433 saturates and the FET 432 enters the OFF state. When the pulsating voltage further increases, the constant current circuit 440 starts to operate and brings the current I to a constant value L2. When the pulsating voltage falls, the reverse operation is performed.

As explained above, in the present embodiment, when controlling the number of LEDs caused to light up included in the LED string in accordance with the pulsating voltage, the current I flowing through the LED string is measured and when the current I is equal to or less than a predetermined value, only the partial LED string 407 is caused to light up (more accurately, at the timing of the end of the period of time t3, the partial LED string 408 lights up faintly), and when the current I exceeds the predetermined value, both the partial LED string 407 and the partial LED string 408 are caused to light up. That is, the LED that lights up for a long period of time from the period of time during which the pulsating voltage is low through the period of time during which the pulsating voltage is high, and to the period of time during which the pulsating voltage is low again is an LED included in the partial LED string 407 and the LED that lights up only for a period of time during which the pulsating voltage is high is an LED included in the partial LED string 408.

In the present embodiment, the LEDs 203 that light up only for a period of time during which the pulsating voltage is high are integrated. By doing this, the mounting area is reduced and the lead time is also reduced. However, if the element size of the LED that lights up only for a period of time during which the pulsating voltage is high is small, the effects of the present invention can be obtained, and therefore, it may also be possible to form one LED on each die or package the LEDs. If the LEDs 203 are integrated, it is possible to further reduce the size of the LED 203. If the LED 102 is also downsized, the integration of the LEDs 203 is effective for an LED lighting device whose forward current is small (low power consumption type LED lighting device). Further, it may also be possible to integrate the LEDs 102. However, the LED 102 emits light for a long period of time, and therefore, when it is preferable for the LEDs 102 to be dispersed on the substrate 101 (see FIG. 1), it is recommended to not integrate the LEDs 102.

In the present embodiment, explanation is given using a case as an example, in which the element size of the LED 102 included in the part that lights up for a long period of time is larger than the element size of the LED 203 included in the part that lights up only for a short period of time, if the element size of the LED 102 included in the part that lights up for a long period of time differ from the element size of the LED 203 included in the part that lights up only for a short period of time, the embodiment is not limited to the case as an example.

In the present embodiment, current is detected when switching the numbers of LEDs connected in series in the LED string, however, it may also be possible to detect voltage when switching the numbers of LEDs connected in series. However, by the system in which the numbers of LEDs connected in series are switched by detecting voltage, there is a case where the current waveform has a sharp peak at the time of switching of the numbers of LEDs connected in series and harmonic noise is induced. In contrast to this, by monitoring current so as to follow an increase or decrease in voltage as in the present embodiment, it is possible to bring an excellent state for the harmonic noise, power factor, and distortion factor.

In the present embodiment, since the effective value of the commercial AC power source is supposed to be 100 V, the numbers of the LEDs 102 and 203 connected in series are taken to be 36. When the commercial power source is 200 V to 240 V, it is sufficient to set the number of LEDs connected in series to 60 to 80.

In the present embodiment, as illustrated in FIG. 5, the LED string is divided into the partial LED string 407 and the partial LED string 408. However, the number of divided LED strings is not limited two and for example, it may also be possible to divide the LED string into three partial LED strings. In this case, it is sufficient to increase the largest element size of the LED included in the partial LED string that lights up for the longest period of time, to set the element size of the LED included in the partial LED string that lights up for the second longest period of time to an intermediate value, and to make the smallest the element size of the LED included in the partial LED string that lights up only for the shortest period of time.

Figure 7:
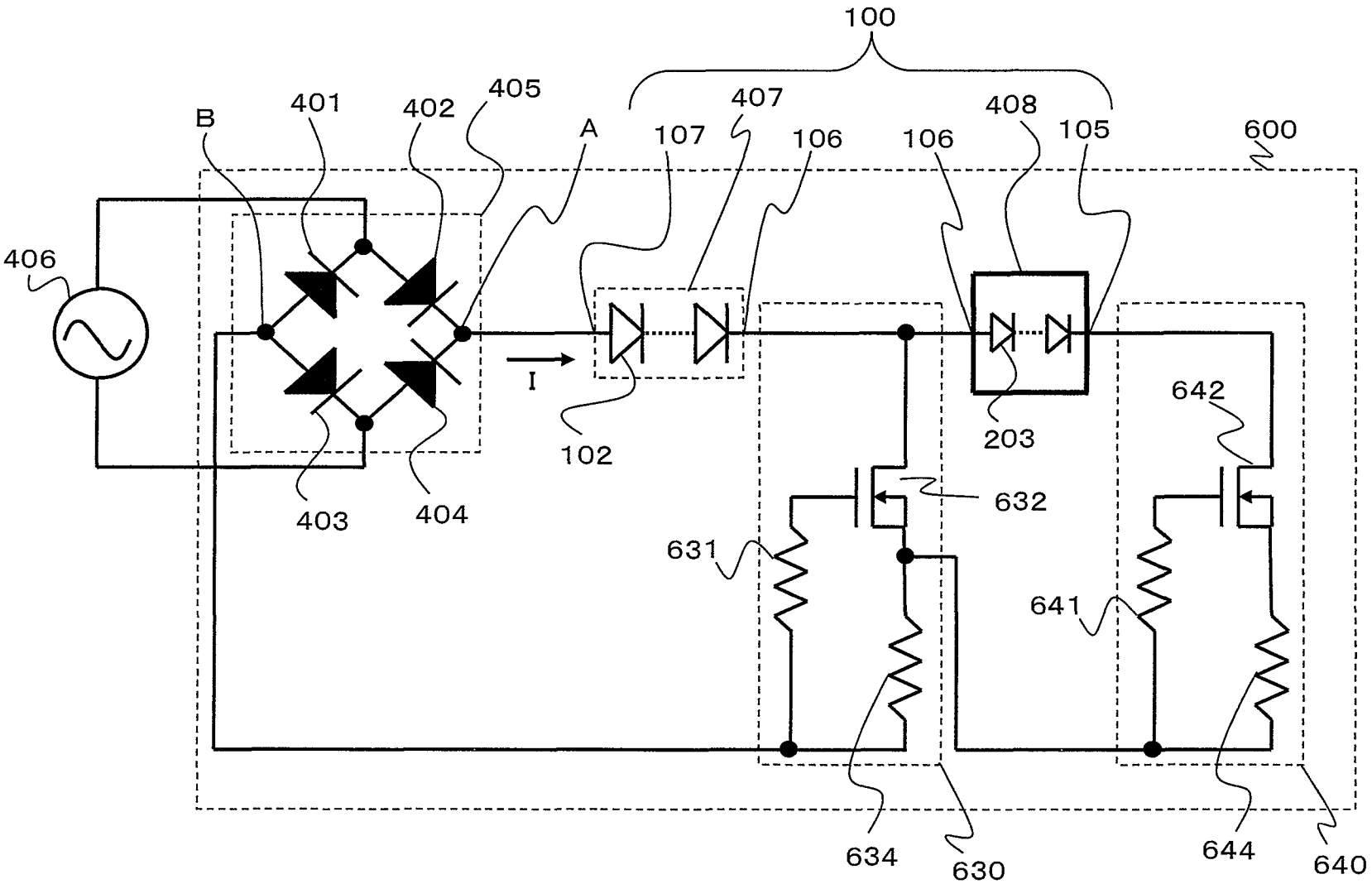
FIG. 7 is a circuit diagram illustrating other circuit for driving the light emitting unit illustrated in FIG. 1.
Figure 8:
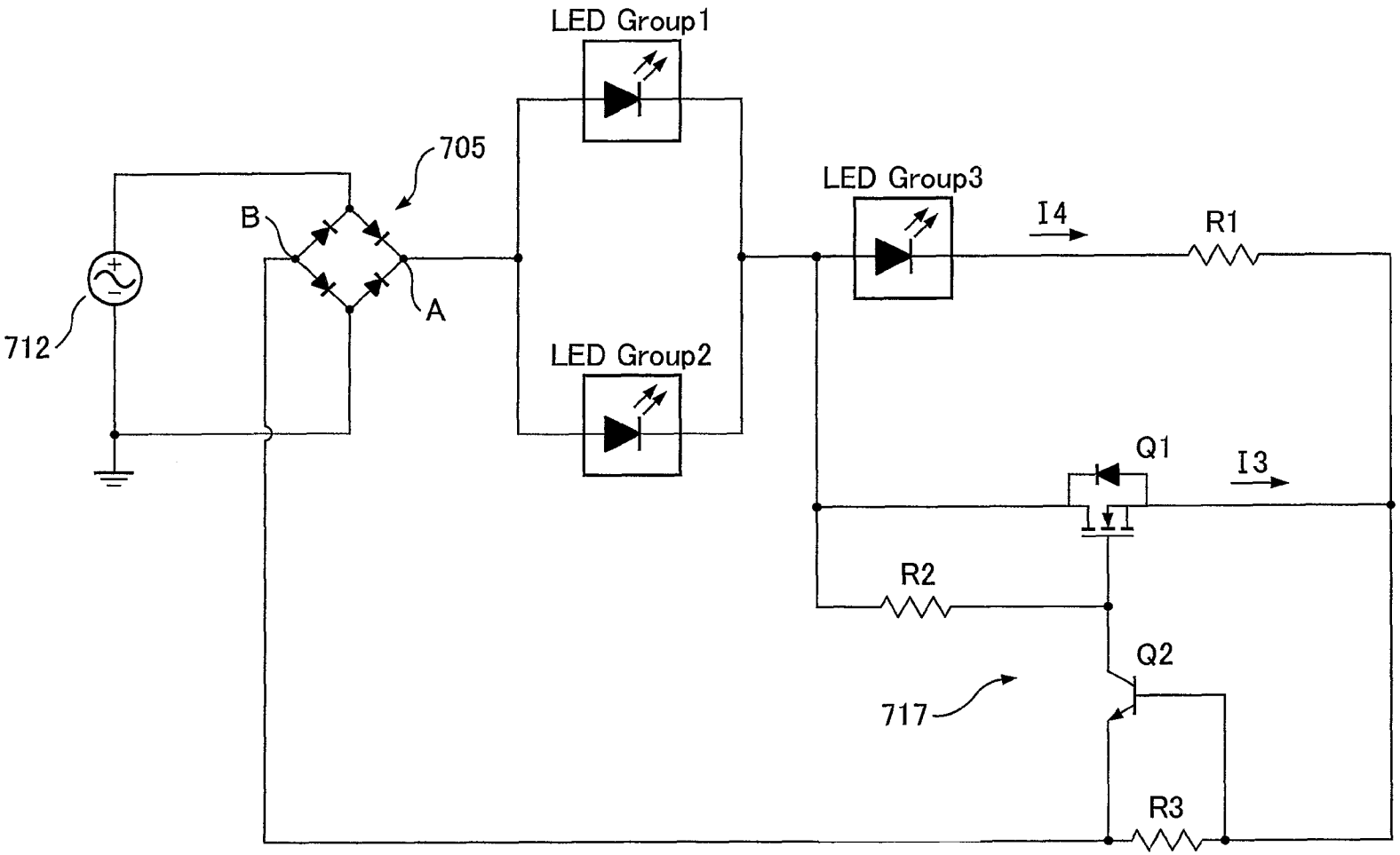
FIG. 8 is a circuit diagram illustrating a traditional LED driving circuit.

In the LED lighting device 400 explained hitherto, the bypass circuit 430 and the constant current circuit 440 use the enhancement type FET transistors 432 and 442. In contrast to this, if a depression type FET is used, the circuit can be simplified. An LED lighting device 600 of another embodiment of the present invention, which uses the depression type FET, is explained. FIG. 7 is a diagram of a circuit for driving the light emitting unit 100 illustrated in FIG. 1. FIG. 7 differs from FIG. 5 only in a bypass circuit 630 and a constant current circuit 640.

The bypass circuit 630 includes resistors 631 and 634 and a depression n-type MOS transistor 632 (hereinafter, referred to as a FET). The resistor 631 is a protection resistor for protecting the gate of the FET 632 from a surge and the resistor 634 is a resistor for detecting current. As the current flowing through the resistor 634 increases, the current between source and drain of the FET 632 is cut off.

The constant current circuit 640 includes resistors 641 and 644 and a depression n-type MOS transistor 642 (hereinafter, referred to as a FET). The resistor 641 is a protection resistor for protecting the gate of the FET 642 from a surge and the resistor 644 is a resistor for detecting current. Feedback is applied to the FET 632 so that the current flowing through the resistor 644 is constant.

What is claimed is:

1. An LED lighting device comprising an LED string in which a first LED string and a second LED string are in series connected to each other, as a light source, wherein a pulsating current is applied to the LED string, the first LED string is capable of lighting up for a long period of time during which the pulsating voltage is in a range from low to high within a period of the pulsating current, and the second LED string is capable of lighting up only for a short period of time during which the pulsating voltage is high within a period of the pulsating current, and the element size of an LED included in the first LED string is different from the element size of an LED included in the second LED string.

2. The LED lighting device according to claim 1, wherein the element size of the LED included in the first LED string is larger than the element size of the LED included in the second LED string.

3. The LED lighting device according to claim 1, wherein the second LED string is integrated.

4. The LED lighting device according to claim 1, comprising a bypass circuit at a connection part of the first LED string and the second LED string, wherein a current is caused to flow into the bypass circuit from the first LED string until the current flowing into the second LED string exceeds a predetermined value.

5. The LED lighting device according to claim 4, wherein the bypass circuit includes a depression type FET.

6. The LED lighting device according to claim 2, wherein the second LED string is integrated.

7. The LED lighting device according to claim 6, comprising a bypass circuit at a connection part of the first LED string and the second LED string, wherein current is caused to flow into the bypass circuit from the first LED string until the current flowing into the second LED string exceeds a predetermined value.

8. The LED lighting device according to claim 7, wherein the bypass circuit includes a depression type FET.

9. The LED lighting device according to claim 2, comprising a bypass circuit at a connection part of the first LED string and the second LED string, wherein current is caused to flow into the bypass circuit from the first LED string until the current flowing into the second LED string exceeds a predetermined value.

10. The LED lighting device according to claim 9, wherein the bypass circuit includes a depression type FET.

11. An LED lighting device comprising an LED string in which a first LED string and a second LED string are in series connected to each other, as a light source, wherein a pulsating current is applied to the LED string, the first LED string is capable of lighting up for a long period of time during which the pulsating voltage is in a range from low to high within a period of the pulsating current, and the second LED string is capable of lighting up only for a short period of time during which the pulsating voltage is high within a period of the pulsating current, and the second LED string is integrated.

12. The LED lighting device according to claim 11, comprising a bypass circuit at a connection part of the first LED string and the second LED string, wherein current is caused to flow into the bypass circuit from the first LED string until the current flowing into the second LED string exceeds a predetermined value.

13. The LED lighting device according to claim 12, wherein the bypass circuit includes a depression type FET.

* * * * *